United States Patent [19]

Yoder

[11] Patent Number: 4,953,820

[45] **Date of Patent: * Sep. 4, 1990**

[54] LAMP WITH RETAINING RING

[75] Inventor: Ronald L. Yoder, Topeka, Ind.

[73] Assignee: Universal Consolidated Methods, Inc., Topeka, Ind.

[ * ] Notice: The portion of the term of this patent subsequent to Feb. 20, 0007 has been disclaimed.

[21] Appl. No.: 335,222

[22] Filed: Apr. 10, 1989

Related U.S. Application Data

[63] Continuation-in-part of Ser. No. 747,122, Jun. 20, 1985.

[51] Int. Cl.[5] ..... B61D 45/00

[52] U.S. Cl. ..... 248/231.5; 410/110

[58] Field of Search ..... 248/228, 229, 231.5, 248/231.6, 316.5, 316.6; 24/265 EC, 265 CD, 115 K; 410/106, 110, 116; 269/249, 238

[56] References Cited

U.S. PATENT DOCUMENTS

| | | | |
|---|---|---|---|
| 804,342 | 11/1905 | Randall . | |
| 934,676 | 9/1909 | Langslow . | |
| 2,164,455 | 7/1939 | Hart . | |
| 2,182,480 | 12/1939 | Lowry . | |
| 2,282,310 | 5/1942 | Dunn | 269/249 |
| 2,609,761 | 9/1952 | Clark | 24/265 CD |
| 2,693,386 | 11/1954 | Renfroe | 269/249 |
| 2,726,693 | 12/1955 | Saxton . | |
| 2,756,693 | 7/1956 | Frost | 410/116 |
| 2,985,174 | 5/1961 | Guth . | |
| 3,288,409 | 11/1966 | Bethea . | |
| 3,893,399 | 7/1975 | Lewis | 24/115 K |
| 3,920,235 | 11/1975 | Hermanns . | |
| 4,147,257 | 4/1979 | Zippel . | |
| 4,161,735 | 7/1979 | Zylla . | |
| 4,191,108 | 3/1980 | Jones | 410/116 |
| 4,293,255 | 10/1981 | Hrasche | 410/110 |
| 4,607,991 | 8/1986 | Porter | 410/110 |
| 4,648,765 | 3/1987 | Kovaleski | 410/110 |
| 4,699,410 | 10/1987 | Seidel | 24/115 K |
| 4,760,986 | 8/1988 | Harrison | 410/110 |
| 4,818,162 | 4/1989 | Zukowski | 410/106 |

FOREIGN PATENT DOCUMENTS

| | | |
|---|---|---|
| 294394 | 7/1953 | Australia . |
| 1477088 | 4/1967 | France . |
| 81397 | 3/1953 | Norway . |
| 650282 | 2/1951 | United Kingdom . |

*Primary Examiner*—Ramon O. Ramirez
*Assistant Examiner*—Robert A. Olson
*Attorney, Agent, or Firm*—Roger M. Rickert

[57] ABSTRACT

An adjustable clamp with an attached retaining ring is disclosed. The clamp is formed from two extrusions, an L-shpaed extrusion which includes a groove for receiving the retaining ring along with one portion of a hinge structure, and a U-shaped extrusion which includes a mating portion of a hinge structure. The retaining ring is seated in the groove or channel of the L-shaped extrusion and the edges or lips of the channel crimped closed to capture the retaining ring. The two extrusions are hingedly joined and then a bolt passed through one and into the other to form the clamp.

5 Claims, 1 Drawing Sheet

LAMP WITH RETAINING RING

CROSS REFERENCE TO RELATED APPLICATION

This application is a continuation-in-part of my copending application Ser. No. 747,122, filed Jun. 20, 1985.

SUMMARY OF THE INVENTION

The present invention relates generally to clamping arrangements having provision for connection to ropes, hooks or similar retainers and more particularly to such retainer fitted clamping arrangements formed primarily from extrusions.

The abovementioned copending application discloses a two piece extruded clamp particularly suited to attaching a cap or cover to the bed of a pickup truck. Pickup trucks are frequently used for light hauling, transporting livestock and carrying a wide variety of other loads. Everything from motorcycles to the family dog may, from time to time, be seen in the bed of a conventional pickup truck and many of these loads should be tied down as by rope, straps or elastic cords, or otherwise fastened in place or restrained within the truck bed. It is frequently possible to find a loop, hole or post to facilitate tying a load in place in the truck bed, but such makeshift arrangements are inconvenient and often include passing a rope or cord through a hole having sharp edges frequently resulting in their either not being used at all or at least inadequate fastening of the load. Provision of a readily accessible and easily used attachment point would enhance the likelihood of a truck load being properly secured within the truck bed, and provision of such an attachment point employing a closed loop ring which is not readily misplaced or displaced would be highly desirable.

Among the several objects of the present invention may be noted the provision of an adjustable clamp possessing the desirable attributes of the clamp of the aforementioned copending application which also provides a readily accessibly attachment point for ropes, hooks and similar load securing arrangements; the provision of a clamp with a D-ring affixed thereto; the provision of a technique for pivotably joining a first member formed from a sliced portion of an extrusion and a second member having a generally cylindrical section; the provision of a D-ring attachment to facilitate securing loads in the bed of a pick-up truck; and the provision of a unique technique for pivotably attaching a part to an extruded member. These as well as other objects and advantageous features of the present invention will be in part apparent and in part pointed out hereinafter.

In general, a method of making a retaining ring clamp includes the extrusion of a first member of generally uniform L-shaped cross-sectional configuration with a first pressure pad near one end of the L, a portion of a hinge structure near the other end of the L, and a concave generally cylindrical channel intermediate the L ends. A second member of generally uniform cross-sectional configuration with a second pressure pad near one end and a second portion of a hinge structure adapted to slidingly mate with the portion of the hinge structure of the first member is similarly extruded. A section of a retaining ring is then placed in the cylindrical channel and the edge portions of the first member are crimped closed adjacent the cylindrical channel to capture the retaining ring within the cylindrical channel. The first and second members are then slidingly and thereafter threadedly joined to complete formation of the clamp. The method of extruding the first member may include extruding a blank for the first member to include an extruded channel forming the generally C-shaped cross section with the C ends extending from the first member as relatively narrow lips followed by slicing the extrusion in a plane generally perpendicular to the direction of extrusion.

Also in general and in one form of the invention, an adjustable clamp has first and second members joined for limited relative motion. The first and second members have first and second pressure pads respectively with the pressure pads moving toward and away from one another as the first and second members are subjected to said relative motion. A D-shaped retaining ring is pivotably fixed to one of the members.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
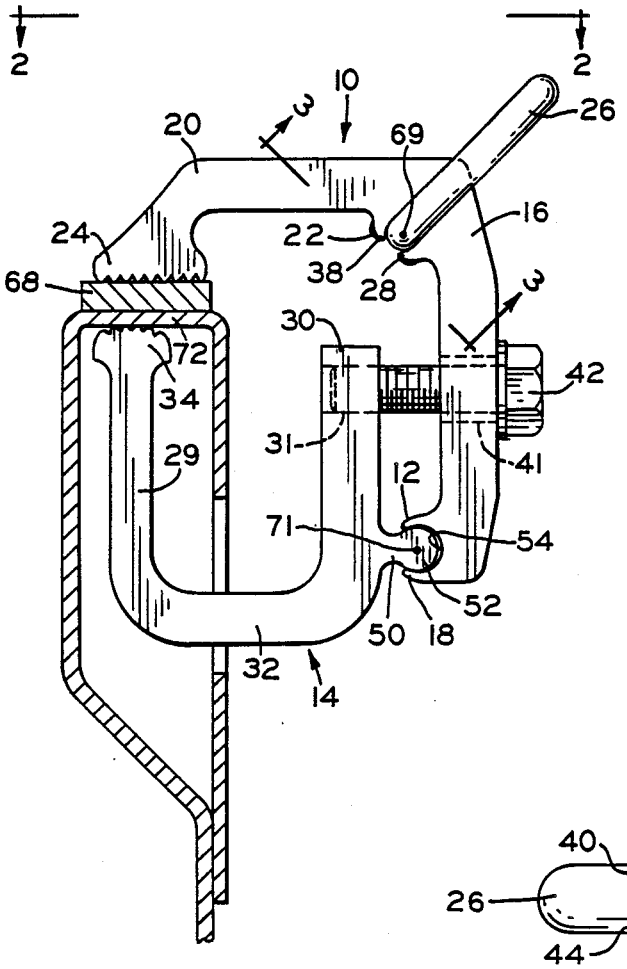
FIG. 1 is a side elevation view of a clamp in an illustrative environment and incorporating the present invention in one form.

The abovementioned copending application addresses the problem of attaching a (typically fiberglass or metal) cover or cap, frequently weighing over 100 pounds, to the open rear body portion of a pickup truck and provides a unique clamping arrangement for solving that problem. Referring to the drawing and particularly to FIG. 1, the adjustable clamp is formed using two extrusions 10 and 14, with extrusion 10 having a body portion 16 and an arm 20 while extrusion 14 is generally U-shaped having two sides 29 and 30 joined together by a bight 32. The first member or extrusion 10 comprises a slice of an extrusion of generally uniform L-shaped cross-sectional configuration with the first pressure pad 24 near one end of the L, a portion 54 of a hinge structure near the other end of the L, and a concave generally cylindrical channel intermediate the L ends. The second member or extrusion similarly comprises a slice of an extrusion of generally uniform cross-sectional configuration with the second pressure pad 34 near one end and a second portion 50 and 52 of a hinge structure adapted to slidingly mate with the portion 54 of the hinge structure of the first member. Extrusions 10 and 14 are joined together by a retaining structure including these integrally extruded hinge portions or retaining members, one consisting of a web 50 and an enlarged bead 52 of greater thickness than the thickness of the web 50 along the edge of the web, and the other formed as a channel 54. The retaining members may be easily joined by longitudinal sliding of one extrusion in the direction of extrusion relative to the other, but once bolt 42 is passed through hole 41 and its threaded shaft is threaded into extrusion 14, the extrusions no longer slide relative to one another and are locked together in the direction of extrusion while remaining free to pivot about axis 71 in a hinge-like manner within a limited range. Channel 54 and the channel which receives the ring 26 are described as being cylindrical in shape, but both are open along an edge and less than a complete closed cylinder. Since the two members may be slid together, the channel 54 may be somewhat greater than hemicylindrical, however, for the closed loop ring 26, no such sliding into its corresponding groove is possible and the groove must be limited to a nearly hemicylindrical configuration to receive the ring from the side rather than axially and subsequently be crimped closed to capture the ring. There is a pressure pad 24 on arm 20 for engaging rail 68 of the truck cap and a pressure pad 34 for engaging a portion 72 of the truck bed. The pressure pads may be extruded serrated ends of the respective extrusions. The clamp is configured so that there is a clearance space between the arm 20 and the extrusion 14 sufficient to receive portions of the bed and cap while still applying the clamping force between the pads 24 and 34. The range of adjustment of the distance between pads 24 and 34, while sufficient for the purposes of the present invention, is limited and significantly less than that of a conventional C-clamp of comparable size since bolt 42 pivots with extrusion 14 relative to extrusion 10 and therefore migrates vertically as shown on the drawing in elongated hole 41 as the bolt is threaded into extrusion 14. Either the elongation of the hole or the length of the bolt may limit bolt migration during clamping.

Figure 3:
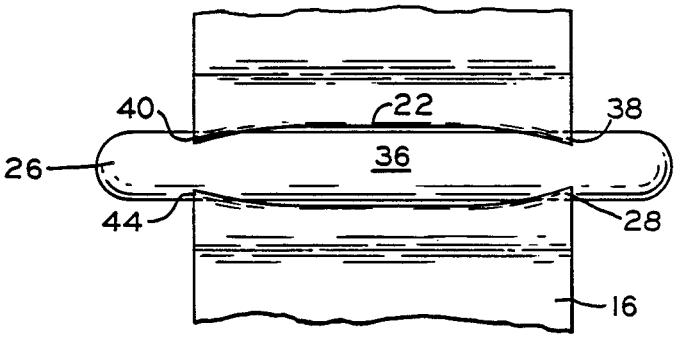
FIG. 3 is a view in cross-section along lines 3—3 of FIG. 1.
Figure 2:
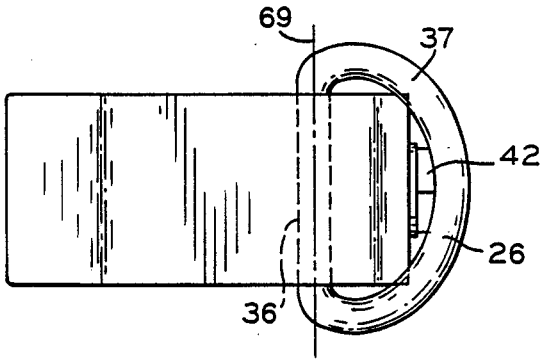
FIG. 2 is a plan view of the clamp of FIG. 1.

The adjustable clamp is formed from slices of first and second extrusions with the slicing being substantially perpendicular to the direction of extrusion and in the plane of the paper as viewed in FIG. 1. The first extrusion 10 is of a uniform generally L-shaped cross-sectional configuration and comprises a body portion 16 with a hole 41 therethrough, an arm 20 extruded along one edge of the body portion extending substantially perpendicular therefrom, and a first pressure pad 24 on the arm. The first extrusion 10 includes a pair of extruded sockets, one forming a part of the hinge structure for joining the two extrusions and the other forming a channel for receiving the retaining ring 26. The first and second members are subjected to a relative pivotal motion about axis 71 as bolt 42 is tightened or loosened while the retaining ring, illustrated here as a D-shaped retaining ring, is pivotably fixed to the first member 10 and pivots within a limited range about the axis 69. The D-shaped ring includes a straight segment or cylindrical portion 36 and an arcuate segment 37, both segments being of generally circular cross-sectional configuration, and the first extrusion 10 includes a concave generally cylindrical channel for receiving the straight segment of the D-shaped ring. The ring 26 may then pivot about the axis 69 of the cylindrical channel. The first and second extrusions or members 10 and 14 are joined for relative pivotal motion about axis 71 with that axis of pivotal motion being parallel to the axis 69 of the cylindrical channel. The closed loop retaining ring 26 is pivotably fastened to the first extrusion by deforming or crimping the lips 28 and 38 toward one another after the cylindrical portion 36 of the D-ring is seated in the channel. The entire lip structure could be deformed to trap the D-ring, or as best seen in FIG. 3, only the lateral tip portions 28, 38, 40 and 44 may be crimped since the forces on the D-ring during use typically pull against the body portion rather than the crimped regions and there is generally no heavy stress on the crimp.

The second extrusion is of a U-shaped cross-sectional configuration and comprises a first side 29, a second side 30 with a threaded hole 31 therethrough and a bight 32 joining the first side 29 to the second side 30. There is a second pressure pad 34 on the first side 29 facing the first pressure pad 34. A hinge-like retaining structure joins the first and second extrusions and comprises a first retaining member comprising a surface portion 54 extruded along the body portion 16 of the first extrusion adjacent the edge of the body portion 16 remote from the arm 20, and a second retaining member 50 and 52 extruded along the second extrusion 14. One of the retaining members, the second retaining member as depicted in the drawing, comprises an integrally extruded web 50 terminating in an integrally extruded bead 52 of greater thickness than the thickness of the web 50. The web 50 of the one retaining member extends from the second extrusion near the bight 32. The other retaining member comprising a pair of integrally extruded portions or lips 12 and 18 partially enclosing a channel 54 of larger cross-sectional size than the bead 52. The integrally extruded portions extend partially together and define therebetween a gap having a width that is greater than the thickness of the web 50 and less than the thickness of the bead 52 so that the bead 52 can be inserted lengthwise into the channel 54 to join the first and second members together. Thus, the body portion 16 and the second side 30 comprise juxtaposed members with the second side 30 extending substantially perpendicular to the arm 20 with the end of the second side 30 being spaced from the arm 20 thereby to provide a space for receiving a workpiece such as the truck bed portions 68 and 72. The hole 41 through the body portion 16 is in alignment with the threaded hole 31 through the second side 30. The arm of the first extrusion and the second side are transversely located and separated, and the hole through the body portion is a clearance hole located between the first retaining member and the arm 20. The body portion of the first extrusion facing the second side of the second extrusion is generally flat. A bolt 42 having a head and a threaded shaft extends through the clearance hole 41 and threadedly engages the threaded hole 31 to urge the juxtaposed members toward each other, whereby the first and second extrusions pivot relatively to each other about the bead.

The method of making a retaining ring clamp of the type thus far described should now be clear. A first member 10 of generally uniform L-shaped cross-sectional configuration is extruded with a first pressure pad 24 near one end of the L, a portion of the hinge structure in the form of groove 54 near the other end of the L, and a concave generally cylindrical channel for receiving the D-ring intermediate the L ends. A second member 14 of generally uniform cross-sectional configuration is similarly extruded with a second pressure pad 34 near one end and a second portion of a hinge structure in the form of web 50 and the enlarged portion 52 along one edge adapted to slidingly mate with the portion of the hinge structure of the first member. A straight section 36 of the retaining ring 26 is inserted into the cylindrical channel. Thereafter, edge portions 28, 38, 40 and 44 of the first member 10 which are adjacent the cylindrical channel are crimped are bent toward one another to capture the retaining ring 26 within the cylindrical channel. The two extrusions 10 and 14 are joined by relative motion along axis 71 and thereafter threadedly joined by passing bolt 42 through the elongated hole 41 and into the threaded hole 31. The process of extruding the first member may include extruding an elongated blank for the first member which includes an extruded channel forming a generally C-shaped cross section with the C ends extending from the first member as relatively narrow lips 22. Then the extrusion is sliced in a plane generally perpendicular to the direction of extrusion to form the first member.

From the foregoing, it is now apparent that a novel arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An adjustable clamp comprising:

a first extrusion comprising a body portion with a hole therethrough, an arm extruded along one edge of the body portion extending substantially perpendicular therefrom, and a first pressure pad on the arm;

a U-shaped second extrusion comprising a first side, a second side with a hole therethrough, a bight joining the first side to the second side, and a second pressure pad on the first side facing the first pressure pad;

a hinge-like retaining structure comprising a first retaining member comprising a surface portion extruded along the body portion of the first extrusion adjacent the edge of the body portion remote from the arm, and a second retaining member extruded along the second extrusion, the second retaining member comprising an integrally extruded web terminating in an integrally extruded bead of greater thickness than the thickness of the web, the web of the second retaining member extending from the second extrusion near the intersection of the second side and the bight and substantially perpendicular to the second side, the other retaining member comprising a pair of integrally extruded portions partially enclosing a channel of larger cross-sectional size than the bead, the integrally extruded portions extending partially together and defining therebetween a gap having a width that is greater than the thickness of the web and less than the thickness of the bead, whereby the bead can be inserted lengthwise into the channel to join the first and second members together, the body portion and the second side thereby comprising juxtaposed members with said second side extending substantially perpenduicular to said arm with the end of said second side being spaced from said arm thereby to provide a space for receiving a workpiece and the hole through the body portion being in alignment with the hole through the second side, the hole through the body portion being a clearance hole located between the first retaining member and the arm and the other of said holes being threaded and located in the second side of the second extrusion, the body portion of the first extrusion facing the second side of the second extrusion being generally flat and substantially coplanar with the deepest part of the channel;

a closed loop retaining ring pivotably fastened to the first extrusion; and a bolt comprising a head and a threaded shaft extending through the clearance hole and threadedly engaging the threaded hole to urge the juxtaposed members toward each other, whereby the first and second extrusions pivot relatively to each other about the bead, said arm of said first extrusion and said second side being transversely located and separated.

2. The adjustable clamp of claim 1 wherein the first extrusion includes a retaining ring receiving channel near the end of the arm opposite the pad.

3. The adjustable clamp of claim 2 wherein the retaining ring receiving channel is a groove of generally C-shaped cross section with the C ends extending from the first extrusion as relatively narrow lips, at least a portion of the lips being deformed toward one another to capture the retaining ring within the channel.

4. The adjustable clamp of claim 2 wherein the retaining ring is generally annular in form with the annulus having a generally circular cross-section, the ring deviating along a section thereof to form a straight segment which straight segment is received within the channel.

5. An adjustable clamp having first and second members joined for limited pivotal relative motion about an axis, the first and second members having first and second pressure pads respectively with the pressure pads moving toward and away from one another as the first and second members are subjected to said relative pivotal motion, and a D-shaped retaining ring pivotably fixed to one of the members, the D-shaped ring including a straight segment and an arcuate segment, both segments being of generally circular cross-sectional configuration, and one of said members including a concave generally cylindrical channel for receiving the straight segment of the D-shaped ring with the ring pivoting about the axis of the cylindrical channel and the axis of said pivotal motion being parallel to the axis of the cylindrical channel, said first member comprising a generally uniform L-shaped cross-sectional configuration with the first pressure pad near one end of the L, a portion of a hinge structure near the other end of the L, and the concave generally cylindrical channel intermediate the L ends, and the second member comprising a generally uniform cross-sectional configuration with the second pressure pad near one end and a second portion of a hinge structure adapted to slidingly mate with the portion of the hinge structure of the first member.

* * * * *